US008649697B2

(12) United States Patent
Arakawa

(10) Patent No.: US 8,649,697 B2
(45) Date of Patent: Feb. 11, 2014

(54) FIXATION DEVICE AND IMAGE FORMATION APPARATUS

(75) Inventor: Kojiro Arakawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 216 days.

(21) Appl. No.: 13/236,743

(22) Filed: Sep. 20, 2011

(65) Prior Publication Data

US 2012/0070173 A1 Mar. 22, 2012

(30) Foreign Application Priority Data

Sep. 21, 2010 (JP) ..... 2010-210572

(51) Int. Cl.
*G03G 15/20* (2006.01)

(52) U.S. Cl.
USPC ..... 399/67; 399/328

(58) Field of Classification Search
USPC ..... 399/67, 69, 328, 329, 331, 332; 219/216
See application file for complete search history.

(56) References Cited

U.S. PATENT DOCUMENTS

| | | | | |
|---|---|---|---|---|
| 4,232,959 | A * | 11/1980 | Ateya et al. | 399/67 |
| 7,113,716 | B2 * | 9/2006 | Tomatsu | 399/67 |
| 7,474,869 | B2 * | 1/2009 | Kim et al. | 399/322 |
| 8,050,608 | B2 * | 11/2011 | Chang | 399/328 |
| 8,150,303 | B2 * | 4/2012 | Kim et al. | 399/328 |
| 2008/0205924 | A1 * | 8/2008 | Fujimoto | 399/70 |

FOREIGN PATENT DOCUMENTS

| | | | |
|---|---|---|---|
| JP | 04280280 | A * | 10/1992 |
| JP | 2005331747 | A * | 12/2005 |
| JP | 2009229726 | A * | 10/2009 |
| JP | 2009-294331 | A | 12/2009 |
| JP | 2010151983 | A * | 7/2010 |

* cited by examiner

*Primary Examiner* — Robert Beatty
(74) *Attorney, Agent, or Firm* — Marvin A. Motsenbocker; Mots Law, PLLC

(57) ABSTRACT

A fixation device includes a first conveyance member, a first press member facing the first conveyance member, a second press member facing the first conveyance member, and a support mechanism supporting the first and second press members and capable of switching whether or not to press the first and second press members against the first conveyance member.

21 Claims, 15 Drawing Sheets

| | LEVER OPERATION AT EACH NIP MODE | | |
|---|---|---|---|
| NIP MODE | MODE B (ROLLER NIP) | MODE A (RELEASED) | MODE C (FULL NIP) |
| PAD LEVER |  |  |  |
| ROLLER LEVER |  |  |  |

FLOWCHART SHOWING OPERATION OF IMAGE FORMING APPARATUS OF EMBODIMENT 1

TIME CHART OF PRINTING OPERATION IN EMBODIMENT 1

PRINTING OPERATION OF IMAGE FORMING APPARATUS AND OPERATION OF FIXATION DEVICE IN EMBODIMENT 1

TIME CHART PRESENTING PROBLEM OF PRINTING OPERATION IN EMBODIMENT 1

TIME CHART OF PRINTING OPERATION IN EMBODIMENT 2

FIXATION DEVICE AND IMAGE FORMATION APPARATUS

CROSS REFERENCE TO RELATED APPLICATIONS

This application claims priority based on 35 USC 119 from prior Japanese Patent Application No. 2010-210572 filed on Sep. 21, 2010, entitled "FIXATION DEVICE AND IMAGE FORMATION APPARATUS", the entire contents of which are incorporated herein by reference.

BACKGROUND OF THE INVENTION

1. Field of the Invention

The present disclosure relates to a fixation device and an image formation apparatus such as an electrophotographic printer, a copier, a facsimile, or the like.

2. Description of Related Art

For conventional image formation apparatuses, there is a known technique to change pressure between a press roller and a fixation roller in a fixation device according to printing conditions in the process to transfer a developer corresponding to a print image to a recording sheet and fuse the developer to the recording sheet by heat and pressure (see Japanese Patent Application Publication No. 2009-294331).

SUMMARY OF THE INVENTION

In the conventional image formation apparatus, the fixation device may include a press pad used as an auxiliary press member such that the unrotatable press pad and the rotatable press roller are simultaneously pressed against the fixation roller, in order to increase the contact area between the fixation device and the recording sheet. If the fixation roller or the press roller is rotated while heating even when no sheet is conveyed between the fixation roller and the press roller, the press pad is gradually degraded, which may cause failures including increasing torque due to friction and insufficient charge.

A first aspect of the invention is a fixation device including: a first conveyance member; a first press member facing the first conveyance member; a second press member facing the first conveyance member; and a support mechanism supporting the first and second press members and capable of switching between whether or not to press the first and second press members against the first conveyance member.

A second aspect of the invention is an image formation apparatus including: the fixation device according to the first aspect; and a controller configured to control the support mechanism to switch between whether or not to press the first and second press members against the first conveyance member.

A third aspect of the invention is a fixation device including: a first conveyance member; a first press member facing the first conveyance member; a second press member facing the first conveyance member; and a controller configured to switch between whether or not to press the first and second press members against the first conveyance member.

According to one of the aspects, the first press member or the second press member can be pressed against the first conveyance member only when a sheet is fed to the fixation device. This allows the first press member or the second press member to come into contact directly or indirectly with the first conveyance member only during a minimum period of time, thus preventing degradation such as abrasion.

DETAILED DESCRIPTION OF THE EMBODIMENTS

Figure 1A:
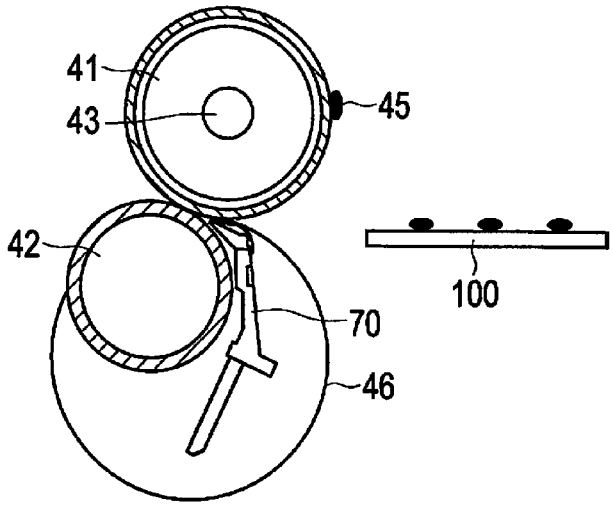
FIGS. 1A and 1B are schematic configuration views showing a fixation device of Embodiment 1.

Descriptions are provided below for embodiments based on the drawings. In the respective drawings, the same constituents are designated by the same reference numerals and duplicate explanation concerning the same constituents is omitted. All of the drawings are provided to illustrate the respective examples only.

[Embodiment 1]

(Configuration of Embodiment 1)

Figure 2:
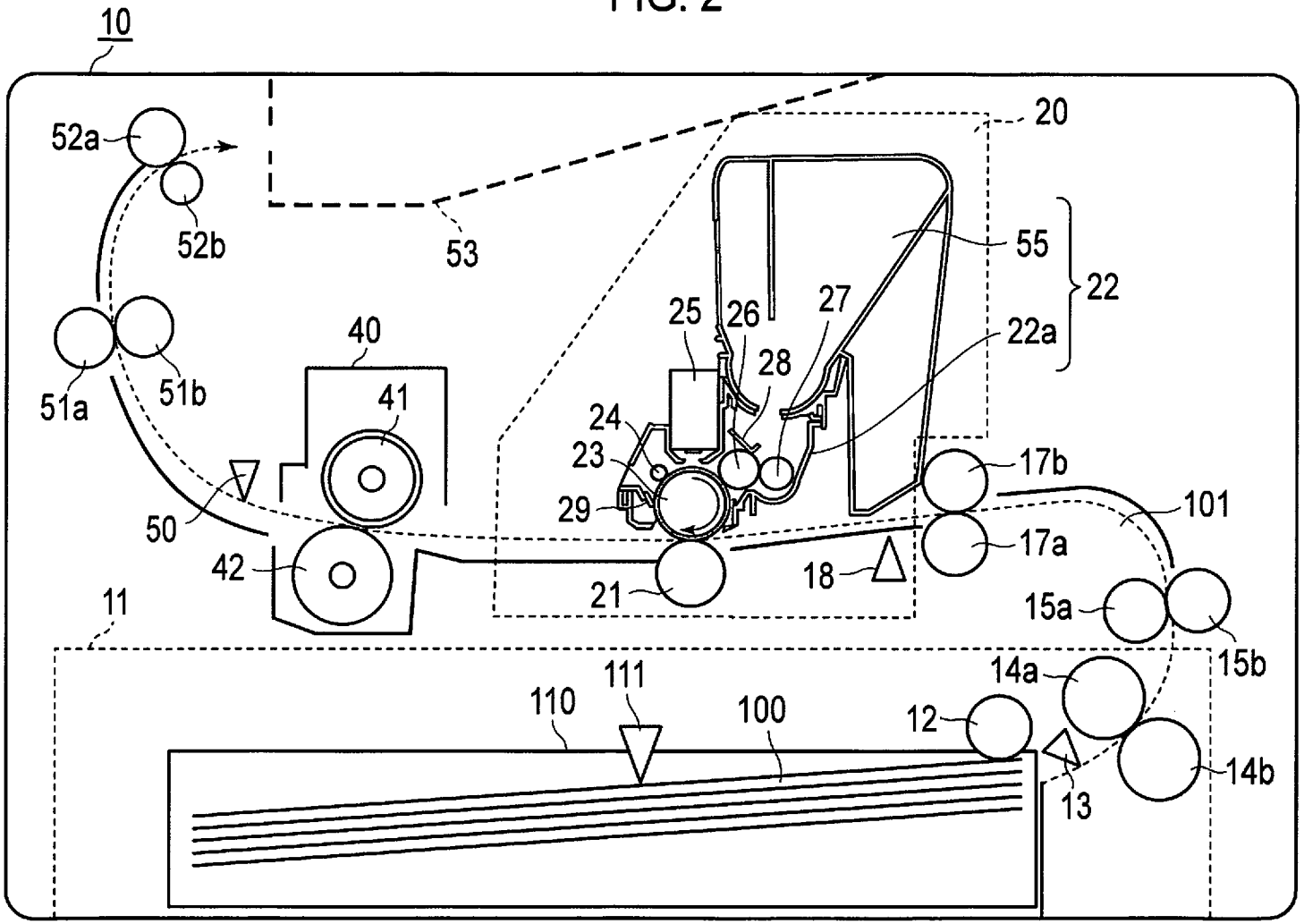
FIG. 2 is a schematic configuration view showing an image formation apparatus of Embodiment 1.

FIG. 2 is a schematic configuration view showing an image formation apparatus of Embodiment 1.

An image formation apparatus 10 includes sheet feeder 11, a conveyance unit (15*a*, 15*b*, 17*a*, and 17*b*, for example), image formation unit 20, fixation device 40, a sheet ejection mechanism, and stacker 53. Sheet feeder 11 feeds recording media (for example, recording sheets) 100. The conveyance unit, or a recording medium conveyance unit, is configured to convey recording sheets 100. Image formation unit 20 forms a toner image as a developer image on each recording sheet 100. Fixation device 40 serves as a fixer or a fuser and is configured to fix the toner image on each recording sheet 100. The sheet ejection mechanism constitutes the recording medium conveyance unit ejecting recording sheets 100. Stacker 53 accommodates ejected recording sheets 100. Image formation apparatus 10 further includes: sheet conveyance motor 19 (shown in FIG. 3, described later) configured to rotate rollers; a clutch turning on/off power transmission to the rollers on medium conveyance path 101; image formation unit power supply 65 shown in FIG. 3, described later; and a low-voltage power supply configured to supply 5V direct current and 24V direct current to the circuit and motors.

Sheet cassette 110 stores recording sheets 100 therein. Sheet feeder 11 includes: sheet cassette 110 loaded at the bottom of image formation apparatus 10; recording sheets 100 stored in sheet cassette 110; sheet sensor 111 configured to determine the presence of recording sheets 100 in sheet cassette 110; pickup roller 12 configured to separate and pick up recording sheets 100 one by one from sheet cassette 110 in conjunction with a strap for separation; hopping sensor 13 configured to determine whether the recording sheets 100 are being fed; sheet feed roller 14*a*; and retard roller 14*b*.

Sheet cassette 110 stores the plurality of recording sheets 100 and is detachably loaded at the bottom of image formation apparatus 10. Recording sheets 100 may be sheets of quality paper, recycled paper, glossy paper, mat paper, OHP (overhead projector) film, or the like and have a predetermined size. Images are recorded on recording sheets 100.

Pickup roller 12 rotates in pressure contact with recording sheets 100. Hopping sensor 13, sheet feed roller 14*a*, and retard roller 14*b* are located downstream of pickup roller 12 in medium conveyance path 101. Sheet feed roller 14*a* and retard roller 14*b* face each other so as to sandwich each recording sheet 100.

The conveyance unit includes conveyance roller 15*a*, pinch roller 15*b*, resist roller 17*a*, and pinch roller 17*b*.

The conveyance roller 15*a* and pinch roller 15*b* are opposed to each other downstream of sheet feed roller 14*a* and retard roller 14*b* in medium conveyance path 101 so as to sandwich each recording sheet 100. Conveyance roller 15*a* is driven by sheet conveyance motor 19 shown in FIG. 3, later described, and pinch roller 15*b* rotates together with conveyance roller 15*a*.

Resist roller 17*a* and pinch roller 17*b* are opposed to each other downstream of conveyance roller 15*a* and pinch roller 15*b* in medium conveyance path 101 so as to sandwich each recording sheet 100. Resist roller 17*a* is driven by sheet conveyance motor 19 shown in FIG. 3, later described, and pinch roller 17*b* rotates together with resist roller 17*a*.

Print start position sensor 18 as a recording medium detector is provided downstream of resist roller 17*a* and pinch roller 17*b* in medium conveyance path 101.

Image formation unit 20 includes image forming unit 22, transfer roller 21, and light emitting diode (hereinafter, referred to as an LED) head 25 as an exposure device. LED head 25 is attached to image forming unit 22 and projects light corresponding to image information onto the surface of photoreceptor drum 23. Furthermore, image forming unit 22 is separated into developer container (hereinafter, referred to as a toner cartridge) 55 positioned in an upper part and image forming unit body 22*a* positioned in a bottom part of image formation unit 20.

Image forming unit body 22*a* includes: photoreceptor drum 23 configured to carry an electrostatic latent image based on the image information; charge roller 24 as a charge member configured to charge photoreceptor drum 23; development roller as a developer supporter configured to develop the electrostatic image on the surface of photoreceptor drum 23 with toner as a developer; supply roller 27 as a supply member configured to supply the toner to development roller 26: development blade 28; and cleaner 29 configured to scrape toner remaining on photoreceptor drum 23. Charge roller 24, development roller 26, and cleaner 29 are pressed against photoreceptor drum 23 with predetermined amounts of contact. Development blade 28 and supply roller 27 are pressed against development roller 26 with predetermined amounts of contact.

Image formation unit 20 includes a development unit configured to develop a toner image on each recording sheet 100, for example.

Photoreceptor drum 23 has a circular cylindrical shape and is rotatably supported. Photoreceptor drum 23 includes a photoreceptor layer on a conductive supporter made of aluminum or the like. The photoreceptor layer includes a photoconductor layer and a charge conveyance layer. Photoreceptor drum 23 is provided so as to abut on charge roller 24, transfer roller 21, and development roller 26. Furthermore, photoreceptor drum 23 is provided so as to come into contact with the tip end of the cleaner 29. Photoreceptor drum 23, serving as an image carrier, is rotatable in a direction indicated by an arrow in the drawing. Photoreceptor drum 23 is configured to retain charges and carry a toner image on the surface thereof. Hereinafter, the constituent components of image formation unit 20 are described sequentially in the rotational direction of photoreceptor drum 23.

Charge roller 24 includes a conductive metallic shaft covered with semiconductive rubber such as silicon rubber and has a circular cylindrical shape. Charge roller 24 is rotatably supported in pressure contact with photoreceptor drum 23. Charge roller 24 is charged by image formation unit power supply 65 shown in FIG. 3, later described, and rotates in pressure contact with photoreceptor drum 23 to apply a predetermined voltage to photoreceptor drum 23. Photoreceptor drum 23 therefore uniformly stores charges in the surface.

LED head 25 includes a plurality of LEDs, a lens array, and an LED driving device and is provided above photoreceptor drum 23. LED head 25 projects light corresponding to image information onto the surface of photoreceptor drum 23 to form an electrostatic latent image on the surface of photoreceptor drum 23.

Supply roller 27 is formed so as to cover a conductive metallic shaft and has a circular cylindrical shape. Supply roller 27 is provided so as to abut on development roller 26. Supply roller 27 has a voltage applied by image formation unit power supply 65 shown in FIG. 3, later described, and comes into pressure contact with development roller 26 to supply toner to development roller 26.

Development roller 26 includes a conductive metallic shaft covered with a semiconductive urethane rubber material or the like and has a circular cylindrical shape. Development roller 26 is provided so as to abut on supply roller 27 and photoreceptor drum 23 and to come into contact with the edge of development blade 28. Development roller 26 has a voltage applied by image formation unit power supply 65 shown in FIG. 3, later described, and attaches toner to the electrostatic latent image formed on the surface of photoreceptor drum 23 to form a toner image. The electrostatic latent image is thus developed.

Development blade 28 as a developer layer controller is made of stainless steel or the like and has a plate shape. Development blade 28 is provided so as to have an edge in contact with the surface of development roller 26. Development blade 28 scrapes excess toner exceeding a certain amount on the surface of development roller 26 to control the thickness of toner attached on the surface of development roller 26 so as to always have a uniform thickness.

Cleaner 29 as a cleaner is made of a rubber member or the like and has a plate shape. Cleaner 29 is provided so as to have an end in contact with the surface of photoreceptor drum 23. Cleaner 29 scrapes toner remaining on photoreceptor drum 23 for cleaning after the toner image formed on photoreceptor drum 23 is transferred to recording sheets 100.

Fixation device 40 includes fixation roller 41, serving as a fuser member or a first conveyance member, and press roller 42, serving as a first press member. Fixation device 40, serving as a fixer or a fuser, is configured to press and heat recording sheets 100 for fusing of toner images.

The sheet ejection mechanism includes ejection sensor 50 as a recording medium detector, ejection rollers 51*a* and 51*b*, and ejection rollers 52*a* and 52*b*. Ejection sensor 50 is provided downstream of fixation device 40 in medium conveyance path 101. Ejection rollers 51*a* and 51*b* are opposed to each other downstream of ejection sensor 50 in medium conveyance path 101 so as to sandwich each recording sheet 100. Ejection rollers 52*a* and 52*b* are also opposed to each other downstream of ejection sensor 50 in medium conveyance path 101 so as to sandwich each recording sheet 100. Ejection rollers 51*a*, 51*b*, 52*a*, and 52*b* are driven by sheet conveyance motor 19 shown in FIG. 3, later described.

Figure 3:
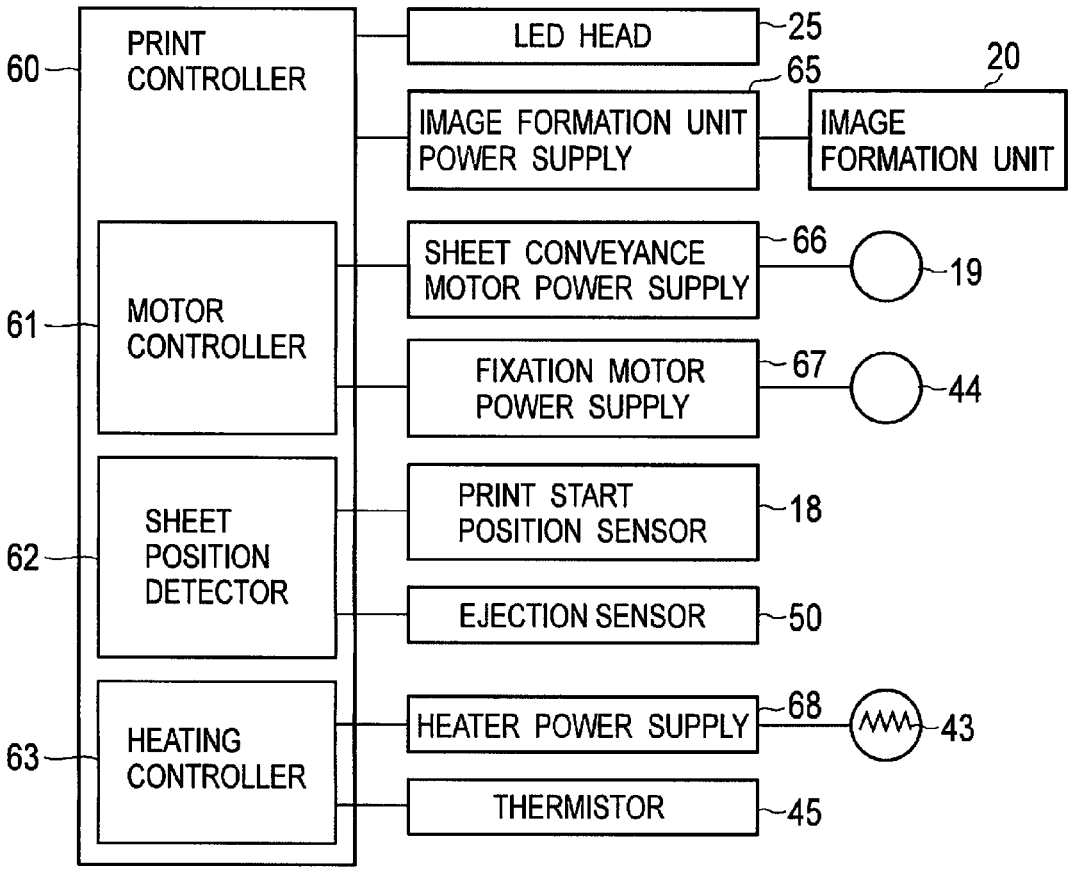
FIG. 3 is a schematic block diagram showing a print controller of the image formation apparatus of Embodiment 1.

FIG. 3 is a schematic block diagram showing a print controller of the image formation apparatus of Embodiment 1.

Figure 1B:
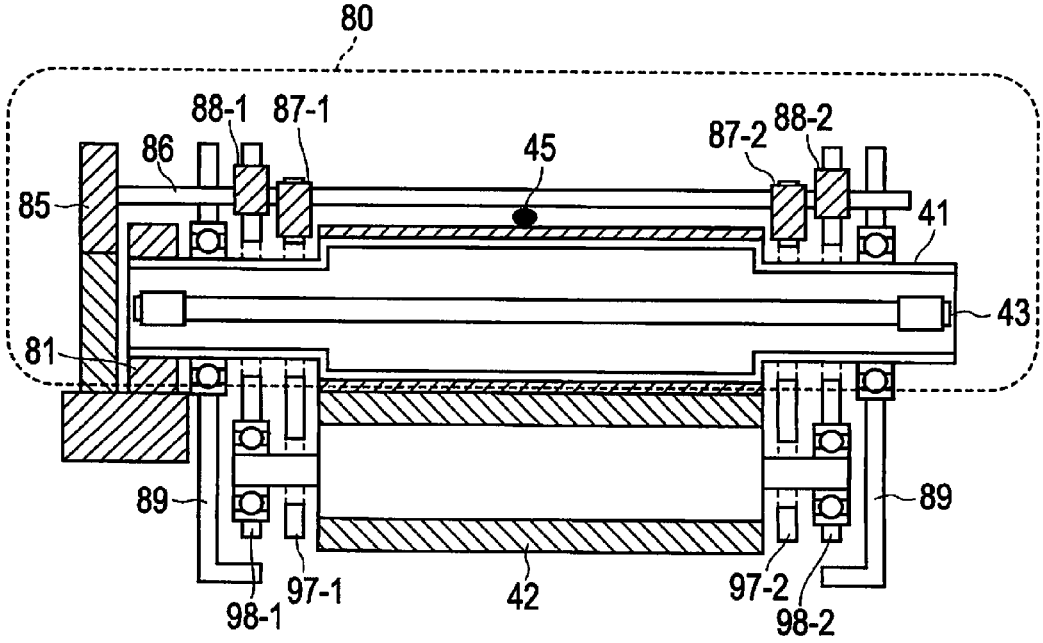

Image formation apparatus 10 includes print controller 60, LED head 25 as the recording light projection member; image formation unit 20 configured to form a toner image corresponding to recording light; image formation unit power supply 65 configured to apply high voltage to image formation unit 20; sheet conveyance motor 19 configured to drive a sheet conveyance unit for conveying recording sheets 100; sheet conveyance motor power supply 66 configured to supply electric power to sheet conveyance motor 19; fixation motor 44 as a drive source configured to drive release mechanism 80 shown in FIG. 1B, later described; fixation motor power supply 67 configured to supply electric power to fixation motor 44; print start position sensor 18; ejection sensor 50; heater 43 as a heater configured to heat fixation roller 41; heater power supply 68 configured to supply electric power to heater 43; and thermistor 45 as a temperature measurement unit measuring temperature of fixation device 40.

Print controller 60 includes motor controller 61, sheet position detector 62, and heating controller 63. Print controller 60 is connected to LED head 25, image formation unit power supply 65, sheet conveyance motor power supply 66, fixation motor power supply 67, print start position sensor 18, ejection sensor 50, heater power supply 68, and thermistor 45. Image formation unit power supply 65 is further connected to image formation unit 20. Sheet conveyance motor power supply 66 is further connected to sheet conveyance motor 19. Fixation motor power supply 67 is further connected to fixation motor 44. Heater power supply 68 is connected to heater 43 incorporated in fixation device 40.

Motor controller 61 is connected to sheet conveyance motor power supply 66 and motor power supply 67. Motor controller 61 controls the driving of sheet conveyance motor 19 and fixation motor 44.

Sheet position detector 62 is connected to print start position sensor 18 and ejection sensor 50. Sheet position detector 62 detects the position of each recording sheet 100.

Heating controller 63 is connected to heater power supply 68 and thermistor 45. Heating controller 63 detects temperature of thermistor 45 and controls heater power supply 68 to heat and control fixation roller 41 to a constant temperature based on the result of detection.

FIGS. 1A and 1B are schematic configuration views showing the fixation device of Embodiment 1. FIG. 1A shows a radial sectional view of fixation device 40, and FIG. 1B shows a longitudinal sectional view of fixation device 40.

As shown in FIG. 1A, fixation device 40 includes: fixation roller 41, serving as a fuser member or a first conveyance member, configured to supply heat to recording sheets 100 and convey recording sheets 100; heater 43 as a heater configured to heat fixation roller 41; fixation belt 46, serving as a second conveyance member, configured to press recording sheets 100 and convey recording sheets 100; press roller 42, serving as the first press member, configured to press fixation belt 46; press pad 70 serving as a second press member; and thermistor 45 as a temperature detecting member configured to detect surface temperature of fixation roller 41.

Recording sheets 100 pass through the nip portion formed between fixation roller 41 and fixation belt 46 from right to left in the drawing to be pressed and heated. The toner image formed on the top surface of each recording sheet 100 is thus developed.

Fixation belt 46 is laid on press roller 42 and press pad 70. Press roller 42 presses fixation roller 41 through fixation belt 46.

Press pad 70 is provided upstream of press roller 42. The edge of press pad 70 is positioned near the nip portion between press roller 42 and fixation roller 41 and presses fixation roller 41 through fixation belt 46.

Heater 43 is provided within fixation roller 41 in a non-contact position with the same. Thermistor 45 is in contact with the surface of fixation roller 41 and measures the surface temperature thereof. Press roller 42 and press pad 70 press fixation roller 41 through fixation belt 46 to form the nip portion.

Thermistor 45 as the temperature measurement unit is a device having resistance varying with temperature. Print controller 60 measures the resistance value to obtain the temperature of thermistor 45. In Embodiment 1, thermistor 45 is a device having a characteristic of resistance decreasing as the temperature increases.

Heater 43 is a heat source such as a halogen heater, for example. When electric power is supplied to a heat generator incorporated in heater 43, heater 43 generates heat and transmits the generated heat to the inner surface of fixation roller 41. The voltage applied to heater 43 is 100 V, and the output of heater 43 is 800 W.

As shown in FIG. 1B, fixation device 40 further includes release mechanism 80. Release mechanism 80, serving as a switch mechanism or a support mechanism, transmits a driving force from fixation motor 44 (see, FIG. 3) to fixation roller 41 for driving the same and controls separation and contact of fixation roller 41, press roller 42, and press pad 70. Release mechanism 80 includes: fixing gear 81; cam gear 85 configured to operate with fixing gear 81 through a group of gears; camshaft 86 fixed at the center of cam gear 85; roller release cams 88-1 and 88-2 fixed at both ends of camshaft 86; pad release cams 87-1 and 87-2 fixed inside of the roller release cams 88-1 and 88-2; press pad levers 97-1 and 97-2 pressed by pad release cams 87-1 and 87-2; press roller levers 98-1 and 98-2 pressed by roller release cams 88-1 and 88-2; and frame 89 covering the aforementioned members.

Press roller 42 is provided under fixation roller 41. Provided to the left of press roller 42 are press pad lever 97-1, not fixed to press roller 42, and press roller lever 98-1, fixed to the shaft of press roller 42. Provided to the right of press roller 42 are press pad lever 97-2, not fixed to press roller 42, and press roller lever 98-2, fixed to the shaft of press roller 42.

Fixation roller 41 has a circular cylindrical shape with a diameter of 30 mm. Fixation roller 41 includes a core tube as a base member made of an iron pipe and an elastic layer covering the core tube. The elastic layer is made of silicon rubber and has a thickness of 1 mm. Fixation roller 41 is driven and rotated by fixation motor 44. When fixation motor 44 rotates forward, fixation roller 41 rotates forward in the direction that recording sheets 100 are conveyed. When fixation motor 44 reverses, fixation roller 41 rotates opposite to the direction that recording sheets 100 are conveyed. Between the fixation motor 44 and fixation roller 41, for example, a one-way gear, a clutch, or the like may be provided so that fixation roller 41 does not rotate when fixation motor 44 reverses.

Press roller 42 has a circular cylindrical shape with a diameter of 20 mm. Press roller 42 includes a core tube as a base member made of an iron metallic solid shaft and an elastic layer covering the core tube. The elastic layer is made of heat-resistant porous sponge and has a thickness of 1 mm. Both ends of press roller 42 are rotatably supported on press roller levers 98-1 and 98-2. Press roller 42 is in contact with fixation belt 46 and rotates together with driven fixation belt 46. Press roller levers 98-1 and 98-2 are supported so as to rotate around rotational shaft 91 shown in FIG. 7, described later.

Frame 89 supports the both ends of fixation roller 41 so that fixation roller 41 freely rotates. Press roller levers 98-1 and 98-2 are placed within frame 89 and support press roller 42 so that press roller 42 freely rotates. Press roller levers 98-1 and 98-2 are provided with holes so as to be prevented from interfering with fixation roller 41 when rotating around rotational shaft 91 shown in FIG. 7, described later.

Press pad levers 97-1 and 97-2 are provided between press roller levers 98-1 and 98-2 and support not-shown press pad 70. Press pad levers 97-1 and 97-2 are provided with holes so as to be prevented from interfering with fixation roller 41 and press roller 42 when rotating around rotational shaft 91 shown in FIG. 7, described later.

Figure 4A:
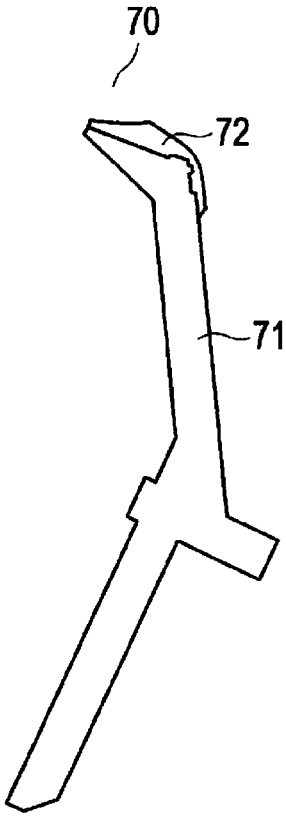
FIGS. 4A and 4B are external views showing a press pad of Embodiment 1.
Figure 4B:
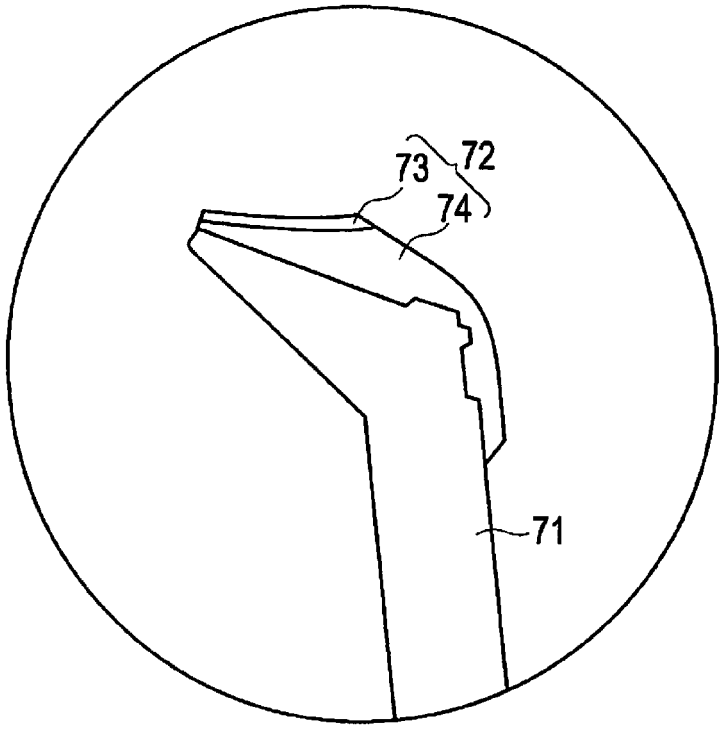

FIGS. 4A and 4B are external views of the press pads in Embodiment 1. FIG. 4A shows an entire exterior of press pad 70, and FIG. 4B shows the edge of press pad 70.

Press pad 70 includes base member 71 and rubber layer 72. Base member 71 has a dogleg shape with a central part protruding in the short-side direction. Base member 71 has a wedge-shaped end at the top.

Rubber layer 72 is formed on the wedge-shaped end of base member 71. Rubber layer 72 is configured to come into contact with fixation belt 46 and press fixation belt 46 to form the nip portion between fixation roller 41 and press pad 70.

Rubber layer 72 includes surface layer 73 and elastic layer 74 as shown in FIG. 4B.

Base member 71 is made of a metallic material such as aluminum, iron, or stainless steel in order to keep a certain degree of rigidity. Surface layer 73 is made of a resin material having high heat resistance and low surface frictional resistance, such as silicon resin or fluorine resin. Elastic layer 74 is made of a rubber material having high heat resistance, such as silicon rubber, silicone rubber sponge, or fluorine rubber.

Figure 5:
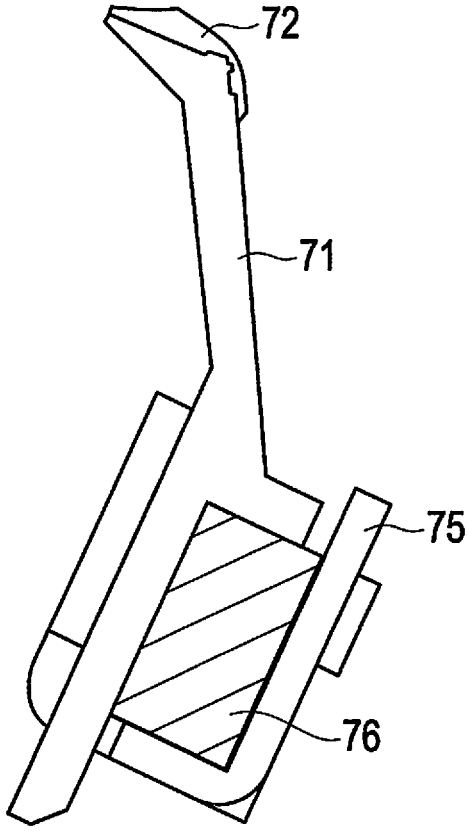
FIG. 5 is a view showing a support frame of the press pad of Embodiment 1.

FIG. 5 is a view showing a support frame of the press pad of Embodiment 1. Press pad 70 is supported by support frame 75 having a square U-shape. Support frame 75 is engaged with central part of base member 71 protruding in the short-side direction and supports the lower part of base member 71. Between the bottom of press pad 70 and support frame 75, a plurality of pad springs 76 pressing press pad 70 in the longitudinal direction are provided.

Figure 6A:
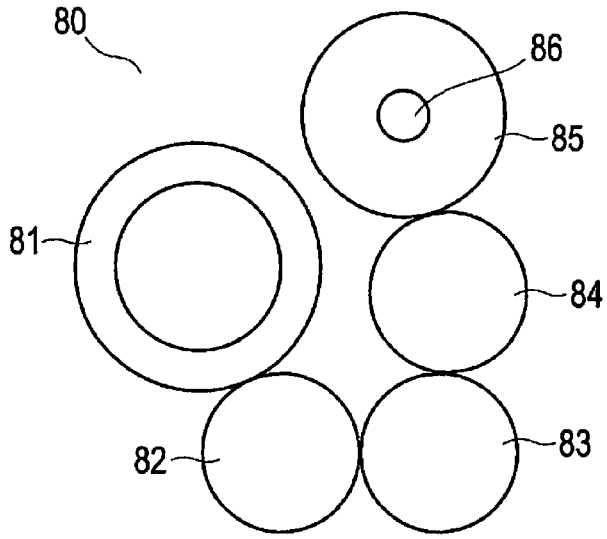
FIGS. 6A and 6B are schematic configuration views showing a release mechanism of Embodiment 1.
Figure 6B:
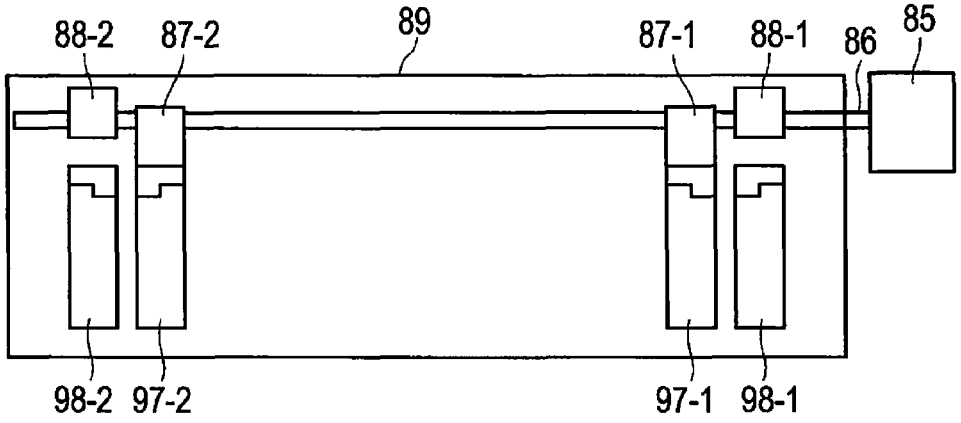

FIGS. 6A and 6B are schematic configuration views showing the release mechanism of Embodiment 1. FIG. 6A is a side view of release mechanism 80, showing a driving force transmission path from the fixation motor, and FIG. 6B is a front view of release mechanism 80, showing a driving force transmission path to the pressure levers.

As shown in FIG. 6A, release mechanism 80 includes: fixing gear 81; reverse gear 82; fixation motor drive gear 83; one-way gear 84 in a gear train transmitting driving force in one rotational direction; cam gear 85 which is connected to one-way gear 84 and rotates only in one direction; camshaft 86 which is fixed to central part of cam gear 85 and rotates together with cam gear 85.

Reverse gear 82 is provided under fixing gear 81. Fixation motor drive gear 83 is provided to the right of reverse gear 82 in the drawing. One-way gear 84 is provided above fixation motor drive gear 83. Cam gear 85 is provided above one-way gear 84.

As shown in FIG. 6B, release mechanism 80 further includes pad release cams 87-1 and 87-2, roller release cams 88-1 and 88-2, press pad levers 97-1 and 97-2, and press roller levers 98-1 and 98-2, which are accommodated in frame 89.

Press pad levers 97-1 and 97-2 and press roller levers 98-1 and 98-2 are fixed to camshaft 86 and are positioned at both longitudinal ends of fixation device 40.

Pad release cams 87-1 and 87-2 and roller release cams 88-1 and 88-2 are opposed to spring 90 shown in FIG. 7, described later, with press pad levers 97-1 and 97-2 and press roller levers 98-1 and 98-2 interposed therebetween, respectively.

Camshaft 86 is rotatably supported. When cam gear 85 rotates, camshaft 86, pad release cams 87-1 and 87-2, and roller release cams 88-1 and 88-2 rotate. When pad release cams 87-1 and 87-2 rotate to a predetermined angle, pad release cams 87-1 and 87-2 press press pad levers 97-1 and 97-2, respectively. When roller release cams 88-1 and 88-2 rotate to a predetermined angle, roller release cams 88-1 and 88-2 press press roller levers 98-1 and 98-2, respectively.

(Operation of Embodiment 1)

The printing operation of image formation apparatus 10 is described based on FIG. 2.

Recording sheets 100 are conveyed along medium conveyance path 101 from the upstream side to the downstream side. Sheet cassette 110 is most upstream, and stacker 53 is most downstream.

Image formation apparatus 10 is connected to a higher level system by wire or wirelessly. When print data is transferred from the higher level system and a print instruction is received, a pickup motor (not shown) rotates pickup roller 12 to separate the plurality of recording sheets 100 one by one and transmit the same to the downstream side in medium conveyance path 101. Hopping sensor 13 on the way detects whether pickup roller 12 normally feeds each recording sheet 100. If pickup roller 12 does not normally feed recording sheet 100, the sheet feeding operation is performed again. At substantially the same time as the start of the sheet feeding operation, image formation unit 20 starts rotation of the rollers and thereby rotates photoreceptor drum 23 more than one turn until recording sheet 100 reaches photoreceptor drum 23.

When sheet conveyance motor 19 rotates sheet feeding roller 14*a*, the rotation of sheet feed roller 41 rotates retard roller 14*b*, which is in contact with sheet feeding roller 14*a*, together. Recording sheet 100 conveyed from pickup roller 12 is conveyed by sheet feeding roller 14*a* and retard roller 14*b* sandwiching recording sheet 100 to conveyance roller 15*a* and pinch roller 15*b* which are positioned downstream in medium conveyance path 101.

Recording sheet 100 is tilted when reaching conveyance roller 15*a* and pinch roller 15*b* because of separation by pickup roller 12 and paper feeding roller 14*b*. Recording sheet 100 is struck on conveyance roller 15*a* and pinch roller 15*b* which are not rotating and is thus brought into an untilted position. After recording sheet 100 is struck, conveyance roller 14*a* is connected to power by a clutch to rotate.

Recording sheet 100 is further conveyed by conveyance roller 15*a*, pinch roller 15*b*, resist roller 17*a*, pinch roller 17*b*, and the leading edge thereof turns on print start position sensor 18. After a certain period of time since print start position sensor 18 is turned on, LED head 25 starts the exposure to form an electrostatic latent image on photoreceptor drum 23.

Photoreceptor drum 23 of image formation unit 20 rotates clockwise as shown in the drawing, and the surface of photoreceptor drum 23 is uniformly charged by charge roller 24 at first. Photoreceptor drum 23, uniformly charged, is exposed to light based on the image information received from the higher level system by LED head 25. On photoreceptor drum 23, an electrostatic latent image is thus formed. Photoreceptor drum 23 with the electrostatic latent image formed thereon is subjected to development by supply roller 27 and development roller 26. A toner image is thus formed. Photoreceptor drum 23 with the toner image developed, sandwiches and conveys recording sheet 100 in conjunction with transfer roller 21. Moreover, transfer roller 21 is supplied with a voltage of about +3000 V to attract toner attached on photoreceptor drum 23 close to recording sheet 100, thus transferring the toner image to recording sheet 100. Recording sheet 100 with the toner image transferred thereon is positively charged by transfer roller 21. Recording sheet 100 is transmitted to fixation device 40 for fusing of the toner image. The toner remaining on photoreceptor drum 23 is scraped off by cleaner 29 and is then accommodated in a waste toner container of toner cartridge 55 by a collecting mechanism (not shown).

Recording sheet 100 with the toner image transferred thereon is sandwiched and conveyed through the nip portion which is pressed to be formed by fixation roller 41 and fixation belt 46 (not shown) in fixation device 40. At the nip portion, recording sheet 100 is heated by fixation roller 41 and is pressed by the energizing force of press pad 70 and press roller 42, shown in FIG. 1 and as described above. The toner therefore melts, and the toner image is fused.

Recording sheet 100 with the toner image fused thereon turns on ejection sensor 50 and is then conveyed by rotating ejection rollers 51*a* and 51*b* and ejection rollers 52*a* and 52*b*. Conveyed recording sheet 100 is then ejected to stacker 53.

Figure 7A:
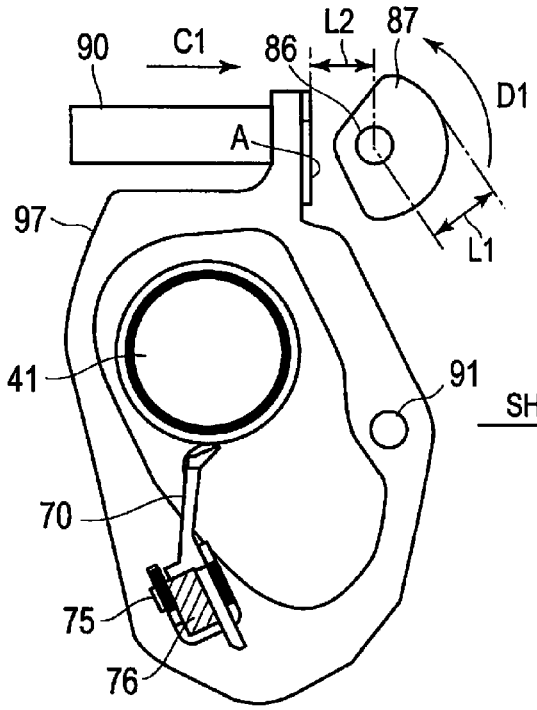
FIGS. 7A and 7B are views showing an operation of a pad lever in Embodiment 1.
Figure 7B:
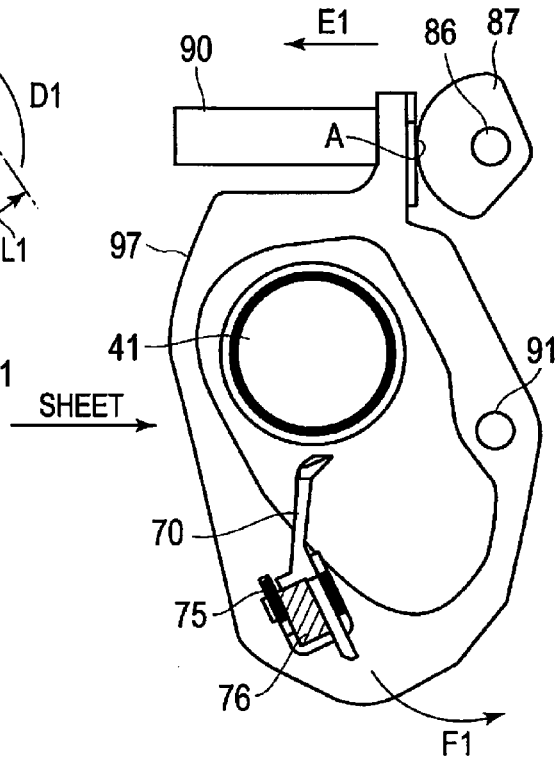

FIGS. 7A and 7B are views showing an operation of the pad levers of Embodiment 1. The pad levers and pad release cams are representatively referred to as pad lever 97 and pad release cam 87 in the following description.

In FIG. 7A, press pad lever 97 supports press pad 70 through support frame 75 and pad spring 76 so that press pad 70 freely expands and contracts. Press pad lever 97 is pressed by spring 90 in a direction indicated by arrow C1. Press pad lever 97 presses press pad 70 upward through rotational shaft 91 by the pressing force of spring 90. Press pad 70 presses fixation belt 46 (not shown) to press fixation roller 41. Pad release cam 87 is fixed to camshaft 86. In FIG. 7A, pad release cam 87 is positioned at such an angle that pad release cam 87 is not in contact with contact portion A of press pad lever 97. In FIGS. 7A and 7B, distance L1 is larger than distance L2 (L1>L2).

A reverse driving force of fixation motor 44 is transmitted through fixing gear 81, reverse gear 82, fixation motor drive gear 83, one-way gear 84, and cam gear 85, which are shown in FIG. 6A described above, to camshaft 86 to rotate pad release cam 87 connected to camshaft 86 in a direction indicated by arrow D1. Forward driving force of fixation motor 44 is not transmitted to camshaft 86 because one-way gear 84 rotates in an idle manner.

Fixation motor 44 is a stepping motor and has a characteristic of its rotational angle varying according to the number of pulses inputted from print controller 60. Fixation motor 44 controls the rotational angle through the number of pulses inputted to fixation motor 44.

In a nip state of fixation roller 41 and press pad 70 (shown in FIG. 7A), press pad lever 97 receives pressure from spring 90 provided between press pad lever 97 and frame 89 and therefore rotates around rotational shaft 91. Expandably supported press pad 70 receives pressure from press pad lever 97 to press fixation roller 41 upward through fixation belt 46.

As shown in FIG. 7B, pad release cam 87, rotated in the direction indicated by arrow D1, presses press pad lever 97 against spring 90 to release press pad 70 supported by press pad lever 97 in a direction indicated by arrow F1.

Figure 8A:
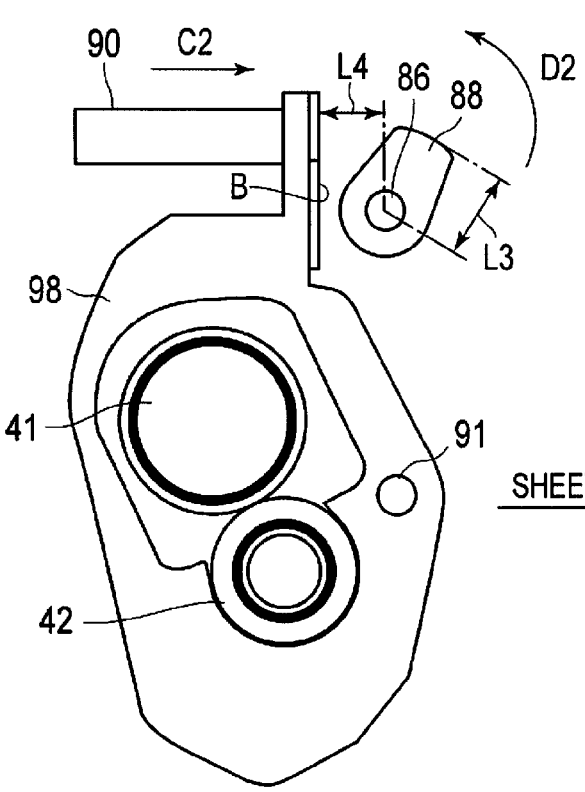
FIGS. 8A and 8B are views showing an operation of a roller lever in Embodiment 1.
Figure 8B:
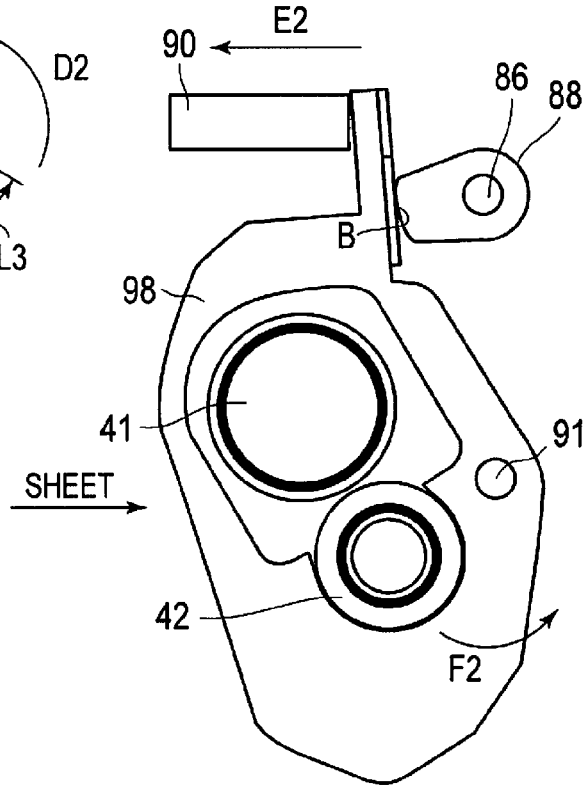

FIGS. 8A and 8B are views showing an operation of the roller levers of Embodiment 1. The roller levers and roller release cams are representatively referred to as roller lever 98 and roller release cam 88 in the following description, respectively.

In a similar manner to pad release cam 87 shown in FIGS. 7A and 7B, reverse driving force of fixation motor 44 rotates roller release cam 88 connected to camshaft 86 in a direction indicated by arrow D2.

In FIG. 8A, press roller lever 98 supports press roller 42 so that press roller 42 freely rotates. Press roller lever 98 is pressed by spring 90 in a direction indicated by arrow C2. Press roller lever 98 presses press roller 42 upward through rotational shaft 91 by the pressing force of spring 90. Press roller 42 presses fixation belt 46 (not shown) and therefore presses fixation roller 41. On camshaft 86, roller release cam 88 is fixed. In FIG. 8A, roller release cam 88 is positioned at such an angle that roller release cam 88 is not in contact with contact portion B of press roller lever 98. In FIGS. 8A and 8B, distance L3 is larger than distance L4 (L3>L4).

As shown in FIG. 8B, roller release cam 88, rotated in a direction indicated by arrow D2, presses press roller lever 98 in a direction indicated by arrow E2 against spring 90 and therefore releases press roller 42 supported by press roller lever 98 in a direction indicated by arrow F2.

Figure 9A:
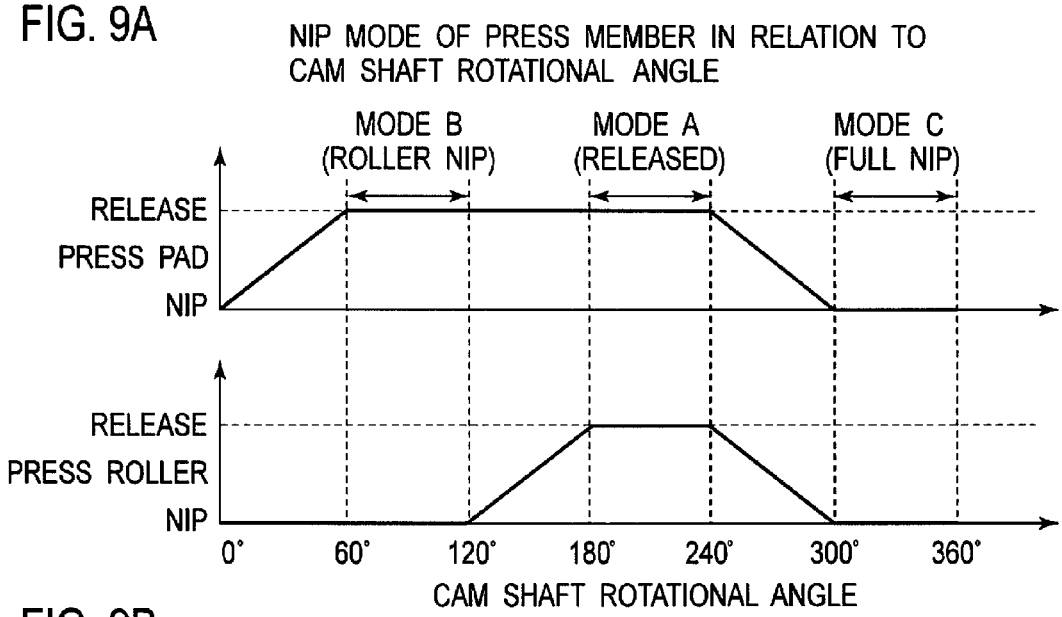
FIGS. 9A and 9B are diagrams showing nip modes of press members at rotational angles of a camshaft.
Figure 9B:
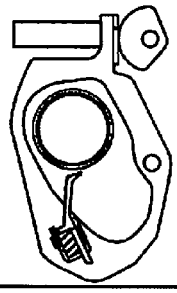
Figure 9B:
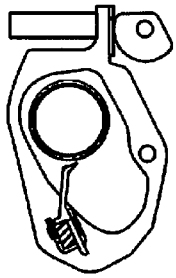
Figure 9B:
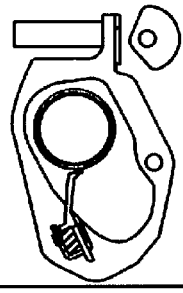
Figure 9B:
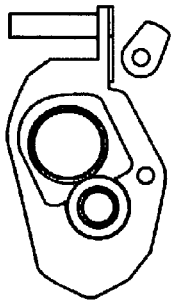
Figure 9B:
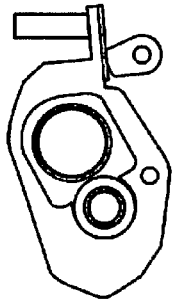
Figure 9B:
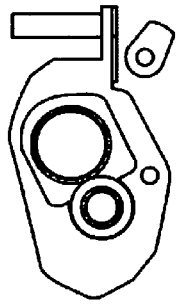

FIGS. 9A and 9B are diagrams showing nip modes of the press members (press roller 42 and press pad 70) for a rotational angle of the camshaft 86. The graph of FIG. 9A shows the nip modes of press pad 70 and press roller 42 for the rotational angles of the camshaft 86. Herein, when the rotational angle of camshaft 86 is 0 degree, each press member (press roller 42 and press pad 70) is in a full nip state. In FIG. 9B, the rows individually show the nip modes of press pad lever 97 and press roller lever 98, and the columns show lever operations at each nip mode.

As shown in FIG. 9A, when the rotational angle of camshaft 86 increases from 0 to 60 degrees, press pad 70 starts to be released. When the rotational angle thereof is between 60 and 120 degrees, the press pad 70 is released, and press roller 42 is in a nip state. Hereinafter, such a state is called mode B (roller nip). The column of mode B (roller nip) of FIG. 9B shows the positions of press pad 70 and press roller 42 in mode B (roller nip).

As shown in FIG. 9A, when the rotational angle of camshaft 86 increases from 120 to 180 degrees, press pad 70 remains released, and press roller 42 starts to be released. When the rotational angle thereof is between 180 and 240 degrees, press pad 80 and press roller 42 are both released. Such a state is called mode A (released) hereinafter. The column of mode A (released) in FIG. 9B shows the positions of press pad 70 and press roller 42 in mode A (released).

As shown in FIG. 9A, when the rotational angle of camshaft 86 increases from 240 to 300 degrees, press pad 70 and press roller 42 are both shifted to the nip states. When the rotational angle thereof is between 300 and 360 degrees, press pad 80 and press roller 42 are both in the nip states. Such a state is called mode C (full nip) hereinafter. The column of mode C (full nip) in FIG. 9B shows the positions of press pad 70 and press roller 42 in mode C (full nip).

Figure 10:
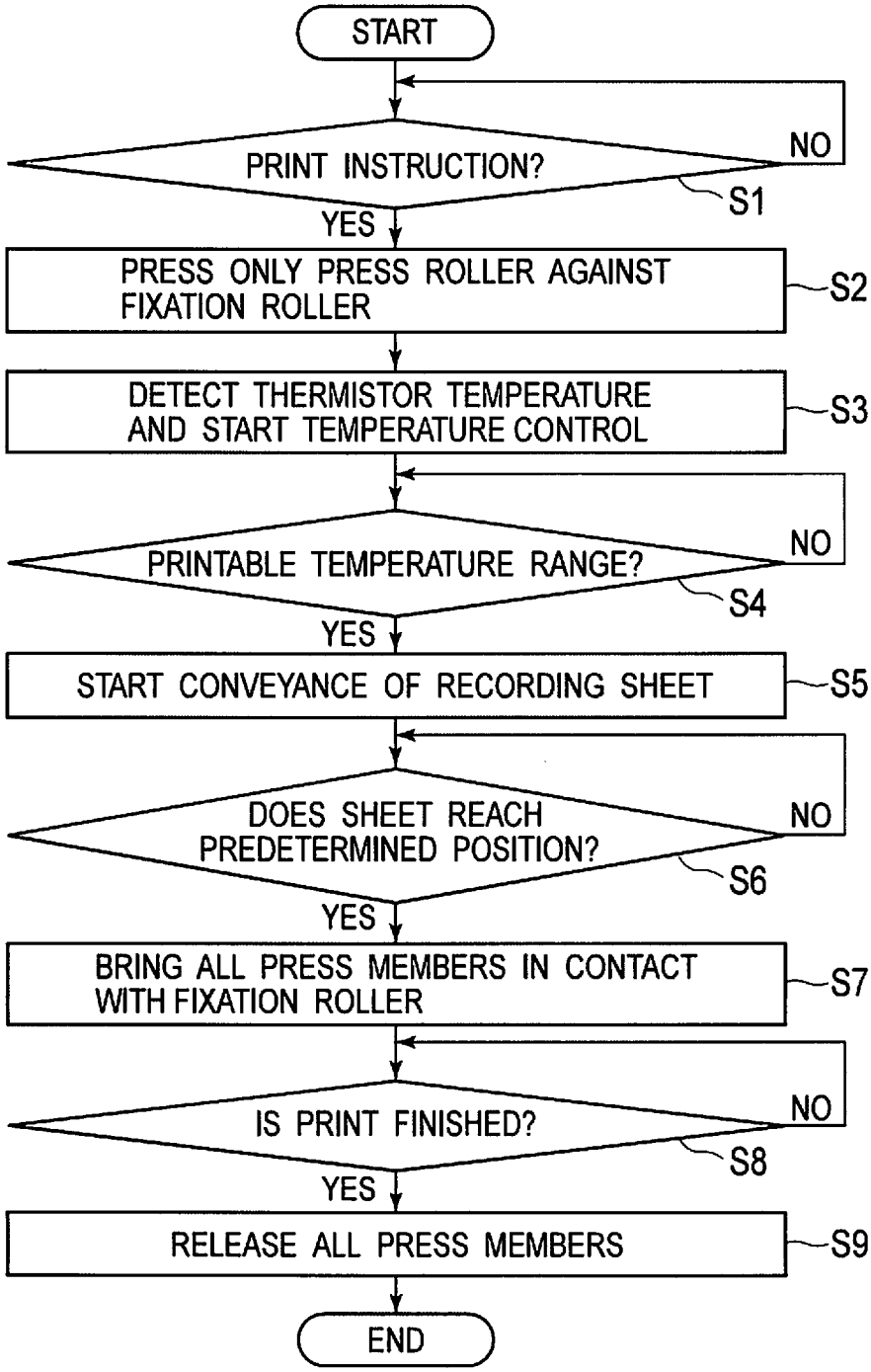
FIG. 10 is a flowchart showing an operation of the image formation apparatus of Embodiment 1.

FIG. 10 is a flowchart showing an operation of the image formation apparatus of Embodiment 1.

In step S1, print controller 60 waits for a print instruction from a higher level apparatus or an external apparatus.

In step S2, print controller 60 controls fixation motor 44 through motor controller 61 and causes only press roller 42 to press fixation roller 41 through release mechanism 80. In short, print controller 60 brings the press members (press roller 42 and press pad 70) into mode B (roller nip).

In step S3, heating controller 63 detects the current temperature Tup of fixation roller 41 through thermistor 45 and sets a control setting temperature Tsp. Heating controller 63 starts to control the temperature of fixation roller 41 and thereby controls setting temperature Tsp through heater power supply 68.

In step S4, print controller 60 sets a lower temperature limit Tlimit and an upper temperature limit T2 of thermistor 45. Print controller 60 compares current temperature Tup with a printable temperature range determined by the lower and upper temperature limits Tlimit and T2. Print controller 60 waits until current temperature Tup reaches the printable temperature range.

Print controller 60 previously stores the setting values including lower and upper temperature limits Tlimit and T2 and control setting temperature Tsp. The setting values are experimentally obtained temperatures.

In step S5, print controller 60 starts to convey recording sheet 100 through motor controller 61. In step S6, print controller 60 waits until sheet position detector 62 and print start position sensor 18 detect that recording sheet 100 reaches a predetermined position.

In step S7, print controller 60 controls the fixation motor 44 through motor controller 61 to cause both press roller 42 and press pad 70 to press fixation roller 41 (mode C (full nip)).

In step S8, print controller 60 continues printing and detects through sheet position detector 62 and ejection sensor 50, whether printing is finished. The print controller 60 determines that recording sheet 100 passes by the ejection sensor 50 and is ejected to stacker 53 if a predetermined period of time elapses after the ejection sensor 50 is turned on and then off. The print controller 60 then determines that the printing (print) is finished.

In step S9, print controller 60 controls fixation motor 44 through motor controller 61 and causes both press roller 42 and press pad 70 to be separated from fixation roller 41 (mode A (released)). Press roller 42 and press pad 70 then stop being pressed, and the pressure thereof is removed. The operation of FIG. 10 is thus terminated.

The operation of FIG. 10 is repeated for each print to release the pressure of press pad 70 before and after each recording sheet 100 passes through fixation device 40.

Figure 11:
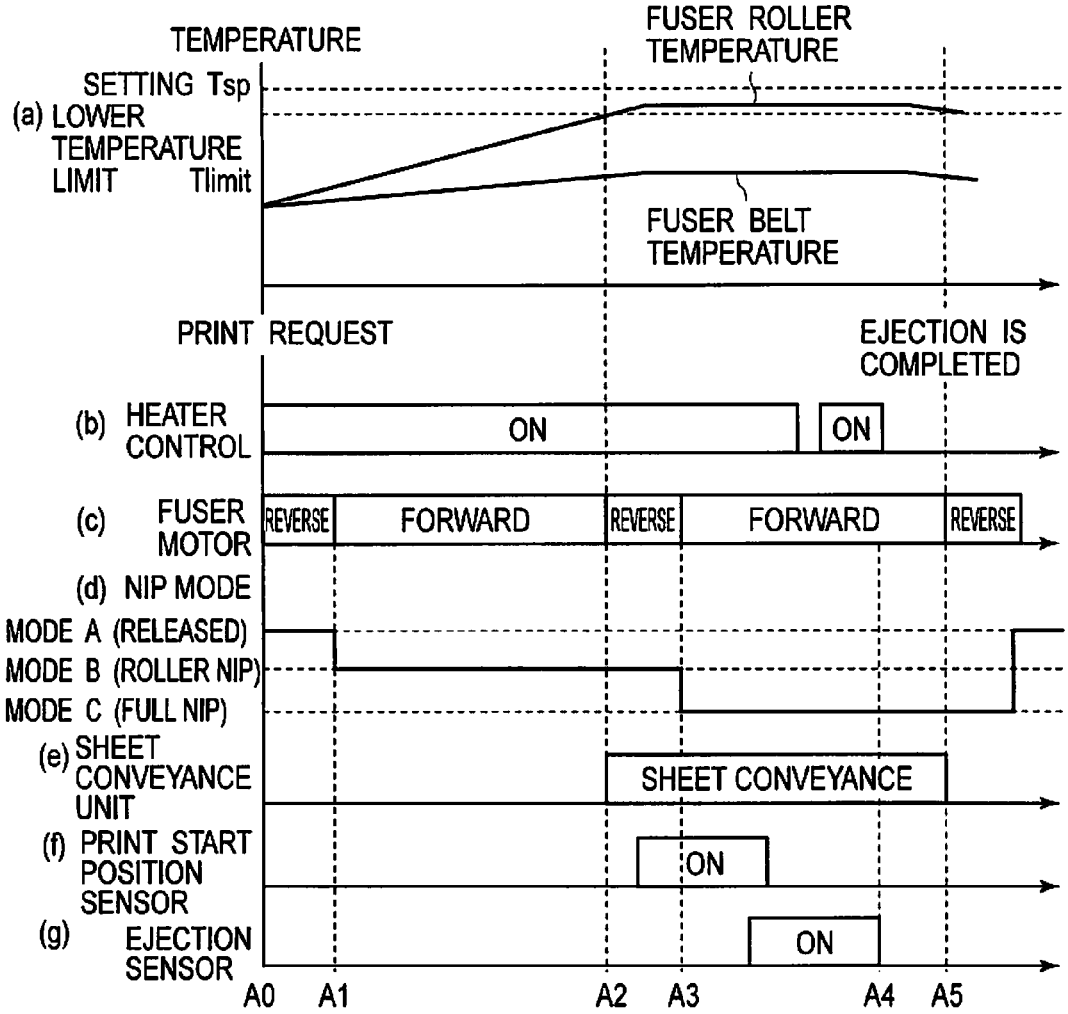
FIG. 11 shows time charts of a printing operation in Embodiment 1.

FIG. 11 shows time charts ((a) to (g)) of the printing operation of Embodiment 1.

FIG. 11(*a*) shows the temperatures of fixation roller 41 and fixation belt 46. FIG. 11(*b*) shows the heater control state. FIG. 11(*c*) shows the drive state of fixation motor 44. FIG. 11(*d*) shows the nip mode of release mechanism 80. FIG. 11(*e*) shows whether the sheet conveyance unit is conveying recording sheet 100. FIG. 11(*f*) shows the state of print start position sensor 18. FIG. 11(*g*) shows the state of ejection sensor 50.

Time A0 is a time when the image formation apparatus 10 receives a print request. At time A0, recording sheet 100 is not conveyed yet as shown in FIG. 11(*e*). Print controller 60 turns on heater 43 to start the heating control as shown in FIG. 11(*b*) and drives fixation motor 44 in reverse as shown in FIG. 11(*c*). As shown in FIG. 11(*d*), the nip mode of release mechanism 80 is mode A (released).

Time A1 is a time when the nip mode of release mechanism 80 becomes mode B (roller nip) after time A0 as shown in FIG. 11(*d*). At time A1, print controller 60 drives fixation motor 44 forward as shown in FIG. 11(*c*). Print controller 60 controls heater 43 while rotating fixation roller 41 to increase the temperatures of fixation roller 41 and press roller 42.

Time A2 is a time when the temperature of fixation roller 41 reaches the printable temperature range as a first temperature range after time A1. The printable temperature range is a range of temperature of fixation roller 41 at which toner can be fused to recording sheets 100. The printable temperature range is defined by lower and upper temperature limits Tlimit and T2. For example, lower and upper temperature limits Tlimit and T2 are 160 and 200° C., respectively.

If the current temperature is higher than upper temperature limit T2, heating controller 63 stops the power supply from heater power supply 68 to heater 43 to reduce the temperature of fixation roller 41 for cooling down.

If the current temperature is lower than lower temperature limit Tlimit, heating controller 63 starts the power supply from heater power supply 68 to heater 43 to increase the temperature of fixation roller 41 for warming up.

At time A2, print controller 60 drives fixation motor 44 in reverse as shown in FIG. 11(*c*) and brings release mechanism 80 into mode C (full nip) as shown in FIG. 11(*d*). At the same time, print controller 60 starts sheet conveyance by the sheet conveyance unit and then starts the image forming operation.

Time A3 is a time when release mechanism 80 becomes mode C (full nip) after time T2. At time A3, print controller 60 drives fixation motor 44 forward as shown in FIG. 11(*c*).

Time A4 is a time when ejection sensor 50 is turned on from off after time A3 and when the trailing edge of recording sheet 100 passes by the ejection sensor 50. At this time, print controller 60 stops the heater control as shown in FIG. 11(*b*).

Time A5 is a time when a predetermined period of time elapses after time A4. At this time, print controller 60 determines that recording sheet 100 is ejected from image formation apparatus 10. Print controller 60 reverses fixation motor 44 as shown in FIG. 11(*c*) and changes the nip mode of release mechanism 80 to mode A (released) as shown in FIG. 11(*d*). Print controller 60 then terminates sheet conveyance by the sheet conveyance unit as shown in FIG. 11(*e*).

Figure 12:
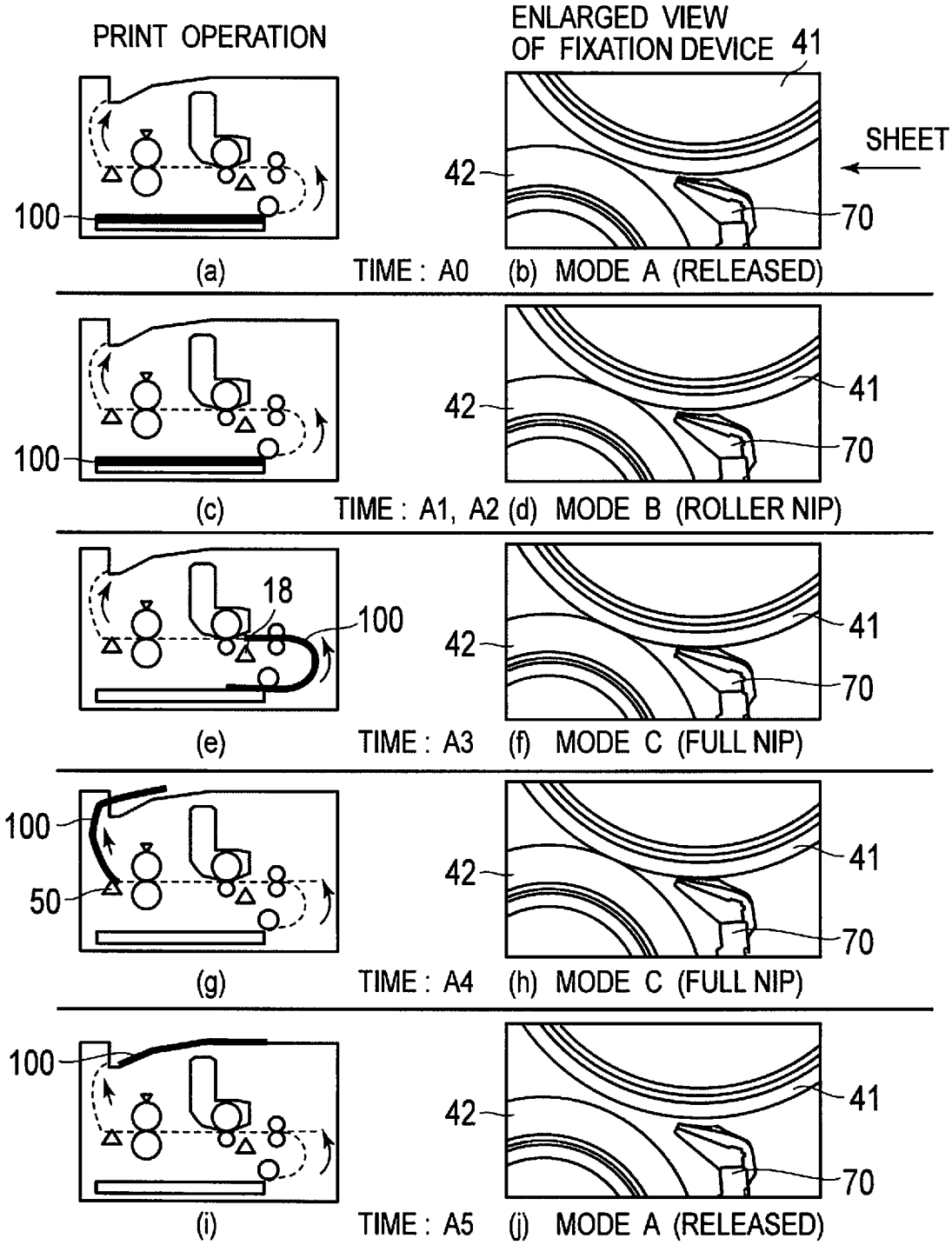
FIG. 12 is a view showing the printing operation of the image formation apparatus and an operation of the fixation device in Embodiment 1.

FIG. 12 ((*a*) to (*j*)) shows the printing operation of the image formation apparatus and the operation of the fixation device in Embodiment 1.

FIG. 12(*a*) shows the printing operation of image formation apparatus 10 at time A0. In FIG. 12(*a*), sheet conveyance is not started yet.

FIG. 12(*b*) shows the operation of fixation device 40 at time A0. Fixation device 40 is in mode A (released).

FIG. 12(*c*) shows the printing operation of image formation apparatus 10 at times A1 and A2. The sheet conveyance is not started yet.

FIG. 12(*d*) shows the operation of fixation device 40 at times A1 and A2. Fixation device 40 is in mode B (roller nip).

FIG. 12(*e*) shows the printing operation of image formation apparatus 10 at time A3. The leading edge of recording sheet 100 reaches the tip of print start position sensor 18. This position is a predetermined position at which press pad 70 is pressed against fixation roller 41.

FIG. 12(*f*) shows the operation of fixation device 40 at time A3. Fixation device 40 is in mode C (full nip).

FIG. 12(*g*) shows the printing operation of image formation apparatus 10 at time A4 after recording sheet 100 gets out of fixation device 40.

FIG. 12(*h*) shows the operation of fixation device 40 at time A4. Fixation device 40 is in mode C (full nip).

FIG. 12(*i*) shows the printing operation of image formation apparatus 10 at time A5. Recording sheet 100 is ejected to stacker 53.

FIG. 12(*j*) shows the operation of fixation device 40 at time A5. Fixation device 40 is in mode A (released).

(Effect of Embodiment 1)

According to fixation device 40 and image formation apparatus 10 of Embodiment 1, press pad 70 presses fixation belt 46 only when each sheet goes through fixation device 40. This allows press pad 70 to be brought into contact with fixation belt 46 only for a minimum period of time, thus preventing degradation due to abrasion and the like.

[Embodiment 2]

(Configuration of Embodiment 2)

Figure 13B:
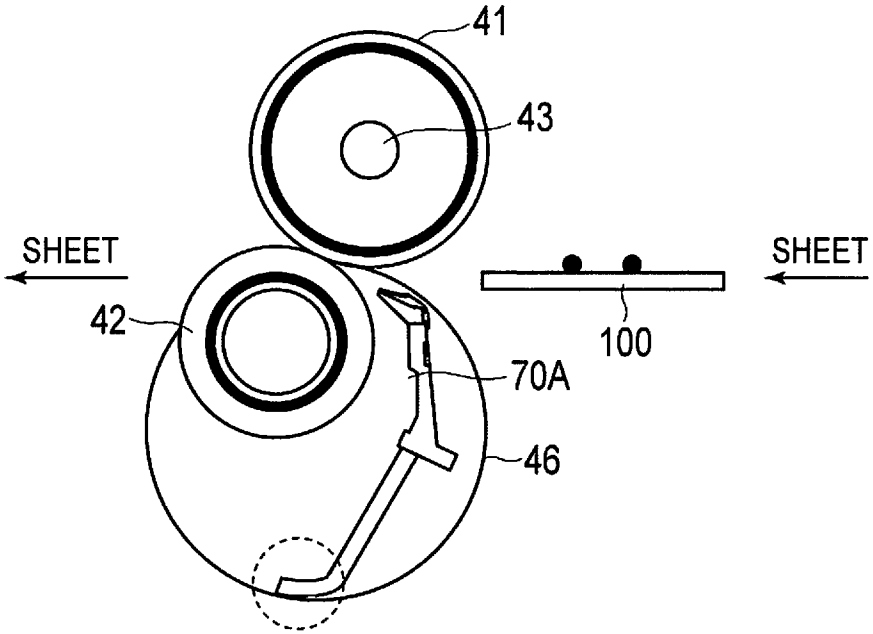
FIGS. 13A and 13B are schematic configuration views showing a fixation device of Embodiment 2.
Figure 13A:
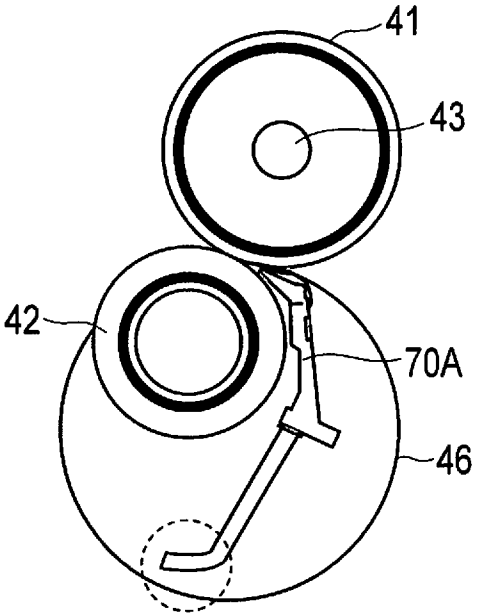

FIGS. 13A and 13B are schematic configuration views showing a fixation device of Embodiment 2. The same elements as those in FIG. 1A showing Embodiment 1 are given the same reference numerals.

Fixation device 40A of Embodiment 2 is the same as the fixation device 40 of Embodiment 1 except that fixation device 40A includes press pad 70A having a shape different from that of press pad 70 of Embodiment 1.

FIG. 13A shows that press pad 70A and press roller 42 both press fixation roller 41 through fixation belt 46.

FIG. 13B shows that only press roller 42 presses fixation roller 41 through fixation belt 46. Press pad 70A is released, and the lower end of press pad 70A is in contact with fixation belt 46.

(Operation of Embodiment 2)

The printing operation of image formation apparatus 10A of Embodiment 2 is the same as that of image formation apparatus 10A of Embodiment 1 shown in FIG. 2.

Figure 14:
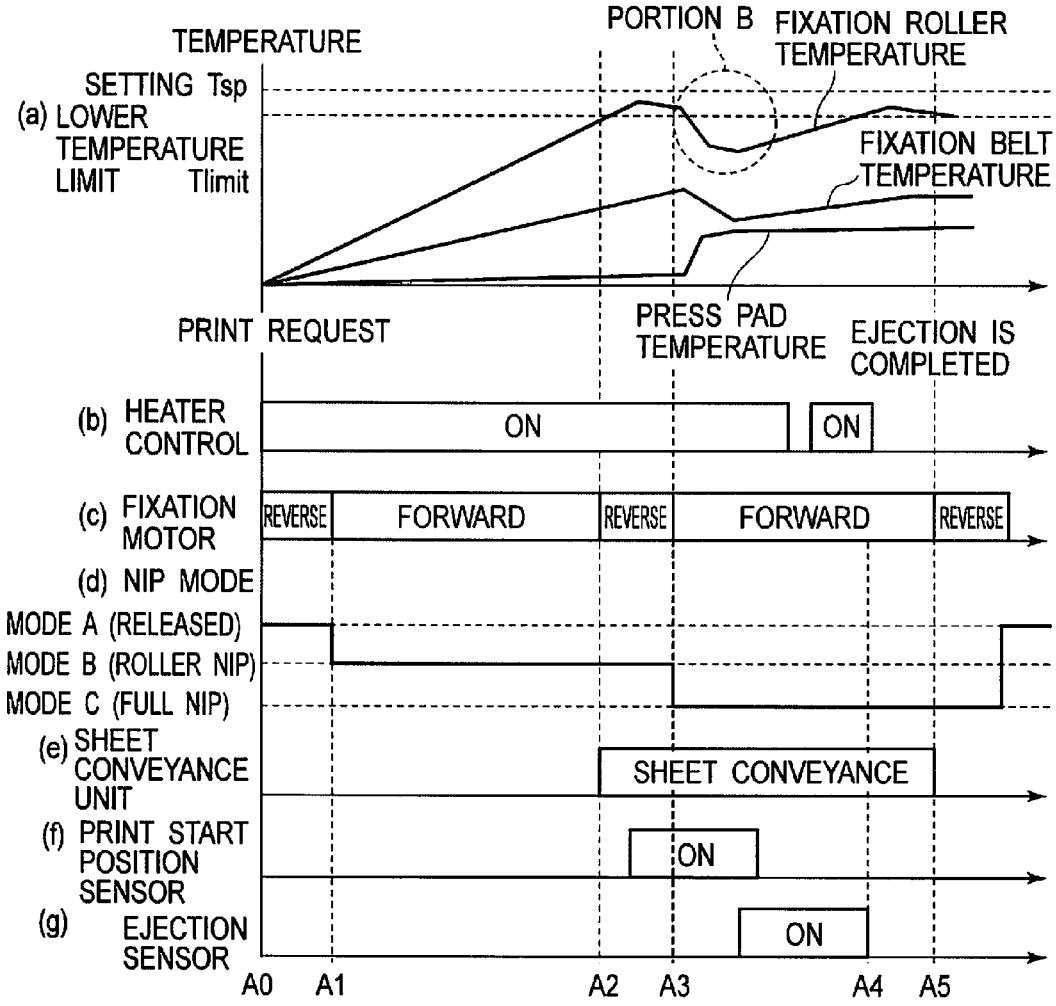
FIG. 14 shows time charts showing a problem of the printing operation of Embodiment 1.

FIG. 14 ((*a*) to (*g*)) shows time charts presenting a problem of the printing operation of Embodiment 1. The same elements as those of FIG. 11 are given the same reference numerals.

FIG. 14 shows a case where print is started with press pad 70 cooled to room temperature in Embodiment 1.

Time A0 is a time where image formation apparatus 10 receives a print request. At time A0, the temperatures of fixation roller 41, fixation belt 46, and press pad 70 are lower than those in the case of FIG. 11(*a*).

Press pad 70 is not in contact with fixation belt 46 between times A0 and A3. The temperature of press pad 70 therefore remains low as shown in FIG. 14(*a*).

At time A3, press pad 70 comes into contact with fixation belt 46. The temperature of press pad 70 is greatly different from the temperature of fixation belt 46. Accordingly, as shown in portion B of FIG. 14(*a*), press pad 70 receives heat to greatly increase its temperature, and fixation belt 46 greatly decreases in temperature. As the temperature of fixation belt 46 decreases, the temperature of fixation roller 41 in contact with fixation belt 46 greatly decreases similarly.

Fixation roller 41 is formed of the members with high heat capacities, such as the core tube and elastic layer. Accordingly, it takes a certain time for heat generated by heater 43 to reach the surface of fixation roller 41 and increase the temperature of fixation roller 41 to the printable temperature again. Fixation roller 41 does not reach the printable temperature yet when recording sheet 100 reaches the fixation device. This can cause insufficient fusing due to a short supply of heat to recording sheet 100.

Accordingly, press pad 70A of Embodiment 2 has a different configuration from that of press pad 70 of Embodiment 1, and a part of press pad 70A other than the nip portion is brought into contact with fixation belt 46 to previously increase its temperature.

Figure 15:
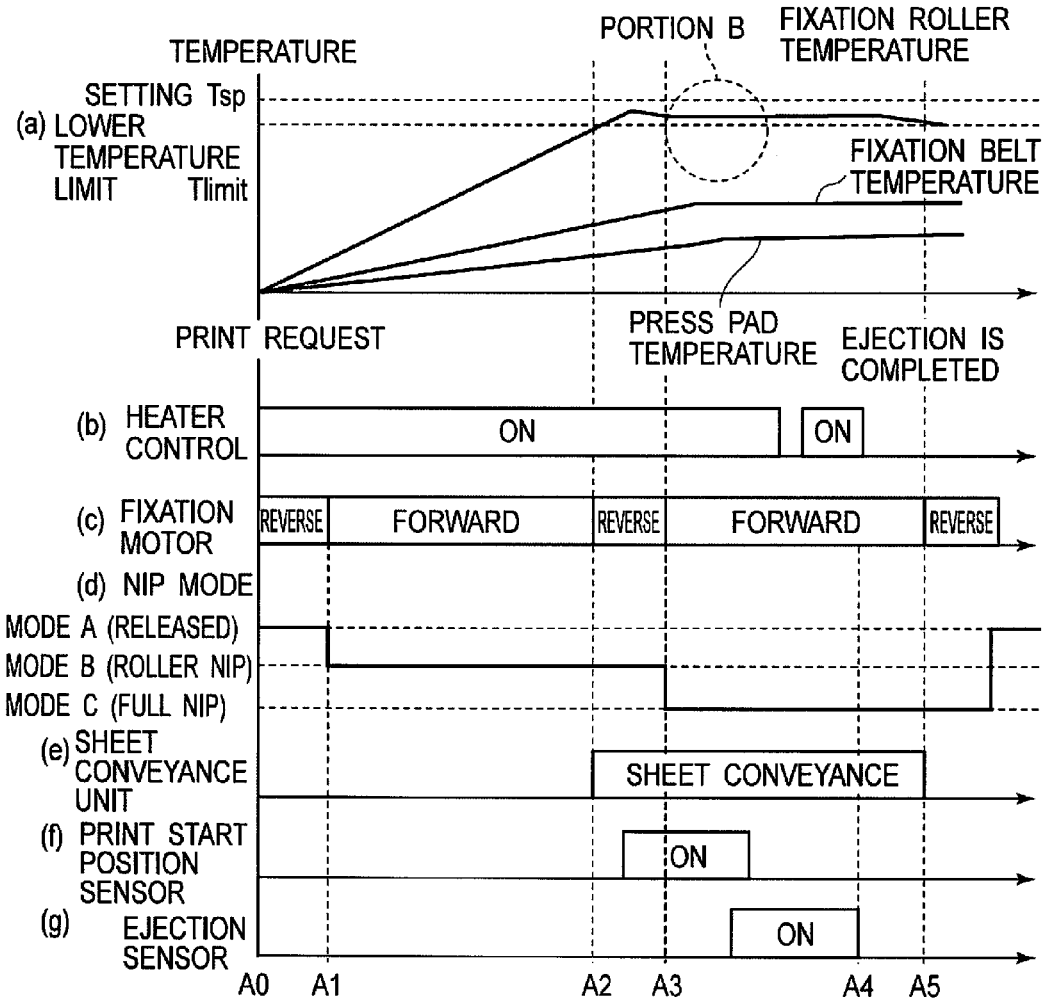
FIG. 15 shows time charts of a printing operation of Embodiment 2.

FIG. 15 ((*a*) to (*g*)) shows time charts of the printing operation in Embodiment 2. The same elements as those in FIGS. 1 and 14 are given the same reference numerals.

Between time A0 and time A3 of Embodiment 2, press roller 42 presses and heats fixation belt 46 during the warming up process. At this time, the lower part of press pad 70A other than the nip portion is in contact with fixation belt 46 which is therefore heated.

At time A3, both of press pad 70A and press roller 42 pressurize the nip portion. Since the temperature of press pad 70A is increased enough, press pad 70A does not greatly decrease the temperature of fixation belt 46 and the surface temperature of fixation roller 41. It is therefore possible to prevent insufficient fusing due to the short supply of heat to recording sheet 100 and the like.

(Effect of Embodiment 2)

According to fixation device 40A and image formation apparatus 10A of Embodiment 2, it is possible to prevent fixation belt 46 from decreasing in temperature due to the press pad 70A with low temperature after fixation belt 46 is brought into contact with press pad 70A in the case where the warming up and print are started with fixation device 40A cooled to room temperature. It is therefore possible to prevent printing failure.

(Modifications)

The invention is not limited to the aforementioned embodiments and can be used and modified in various ways. Such applications and modifications are shown in the following (a) to (f), for example.

(a) Fixation devices 40 and 40A and image formation apparatuses 10 and 10A of Embodiments 1 and 2 are applied to a printer, but the invention is not limited to this. Fixation devices 40 and 40A and image formation apparatuses 10 and 10A of Embodiments 1 and 2 can be applied to copiers, facsimiles, and multifunction printers.

(b) In fixation devices 40 and 40A and image formation apparatuses 10 and 10A of Embodiments 1 and 2, heater 43 is placed in non-contact with fixation roller 41, but the invention is not limited to this. Heater 43 may be placed in contact with fixation roller 41.

(c) In fixation devices 40 and 40A and image formation apparatuses 10 and 10A of Embodiments 1 and 2, thermistor 45 is placed in contact with the surface of fixation roller 41 so as to sense the temperature thereof. However, the invention is not limited to this. Thermistor 45 may be placed in non-contact with fuser roller 41 to sense the temperature.

(d) In image formation apparatuses 10 and 10A of Embodiments 1 and 2, the sheet conveyance position is detected by print start position sensor 18, but the invention is not limited to this. The press state may be changed a predetermined period of time after print start position sensor 18 detects the leading edge of each sheet. Alternatively, instead of using print start position sensor 18, the press state may be changed a predetermined period of time after sheet conveyance motor 19 starts sheet conveyance.

(e) According to fixation device 40A and image formation apparatus 10A of Embodiment 2, press pad 70A is brought into contact with fixation belt 46 to be heated in case warming up or print is started with fixation device 40A cooled to room temperature. However, the invention is not limited to this. If the temperature measured by thermistor 45 is low in a second temperature range, press pad 70A may be heated with press pad 70A and press roller 42 set to mode C (full nip) to prevent printing failure. The second temperature range is a range of temperature from −10 to 30° C., for example. Furthermore, press pad 70A and press roller 42 may be set to mode C (full nip) to be heated if it is detected that the current print is the first print after image formation apparatus 10A is powered on.

(f) In fixation devices 40 and 40A and image formation apparatuses 10 and 10A of Embodiments 1 and 2, the first temperature range is a printable temperature range where toner can be appropriately fused to recording sheets 100. However, the invention is not limited to this. The first temperature range may be a range of temperature which can increase to the printable temperature range while each recording sheet 100 is conveyed from sheet cassette 110 to fixation device 40 or 40A.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. An image formation apparatus comprising a fixation device and a controller, the image formation apparatus comprising:

a temperature measurement unit configured to measure a temperature of the fixation device, the fixation device comprising:

a first conveyance member;

a first press member facing the first conveyance member;

a second press member facing the first conveyance member; and a support mechanism supporting the first and second press members and capable of switching between whether to press the first and second press members against the first conveyance member or to separate the first and second press members away from the first conveyance member, wherein the controller is configured to control the support mechanism to maintain separation of the second press member from the first conveyance member while pressing the first press member against the first conveyance member, until the temperature detected by the temperature measurement unit reaches a predetermined temperature, and to press the first and second press members against the first conveyance member, after the temperature detected by the temperature measurement unit reaches the predetermined temperature.

2. The image formation apparatus according to claim 1, wherein the first press member is configured to be directly pressed against the first conveyance member, and the second press member is configured to be directly pressed against the first conveyance member.

3. The image formation apparatus according to claim 1, further comprising a second conveyance member, wherein the first press member is configured to be pressed against the first conveyance member via the second conveyance member, and the second press member is configured to be pressed against the first conveyance member via the second conveyance member.

4. The image formation apparatus according to claim 1, wherein the support mechanism supports the first and second press members to be movable between a first position wherein the first and second press members are pressed against the first conveyance member and a second position wherein the first press member is pressed against and the second press member is not pressed against the first conveyance member.

5. The image formation apparatus according to claim 1, wherein the support mechanism supports the first and second press members to be movable among a first position wherein the first and second press members are pressed against the first conveyance member, a second position wherein the first press member is pressed against and the second press member is not pressed against the first conveyance member, and a third position wherein neither the first press member nor the second press member are pressed against the first conveyance member.

6. The image formation apparatus of claim 1, wherein the first conveyance member is a roller;

the first press member is a roller; and the second press member is a pad.

7. The image formation apparatus of claim 3, wherein the second conveyance member is an endless belt.

8. The image formation apparatus of claim 1, further comprising a drive source configured to rotate the first conveyance member and being rotatable forward and backward, wherein the support mechanism is configured to be driven via a one-way gear by the drive source such that the support mechanism is not driven with forward rotation of the drive source and is driven with backward rotation of the drive source to switch between whether or not to press the first and second press member against the first conveyance member or to separate the first and second press members against the first conveyance member.

9. The image formation apparatus of claim 8, wherein the support mechanism is driven with backward rotation of the drive source to switch among a first mode of pressing both the first and second press members against the first conveyance member, a second mode of pressing the first press member against the first conveyance member and not pressing the second member against the first conveyance member, and a third mode of not pressing the first nor second press members against the first conveyance member.

10. The image formation apparatus of claim 3, wherein when the second press member is not pressed against the first conveyance member, a portion of the second press member not facing the first conveyance member is in contact with the second conveyance member.

11. The image formation apparatus of claim 2, further comprising a heater configured to heat at least one of the first conveyance member, the first press member, and the second press member.

12. The image formation apparatus of claim 3, further comprising a heater configured to heat at least one of the first conveyance member, the second conveyance member, the first press member, and the second press member.

13. The image formation apparatus of claim 1, further comprising an image formation unit provided upstream of the fixation device and configured to form a developer image, wherein the controller is configured to control, after printing is completed, the support mechanism to move the first and second press members away from the first conveyance member.

14. The image formation apparatus of claim 1, further comprising:

a recording medium conveyance unit configured to convey a recording medium; and a recording medium detector configured to detect a conveyance position of the recording medium, wherein the controller is configured to control the support mechanism of the fixation device based on a detection result from the recording medium detector to switch between whether or not to press the first and second press member against the first conveyance member.

15. The image formation apparatus of claim 14, wherein the controller controls the support mechanism to switch to a mode of not pressing the first and second press member against the first conveyance member, when the recording medium detector detects that the recording medium passes the first conveyance member.

16. The image formation apparatus of claim 14, wherein the controller controls the support mechanism to switch to a mode of pressing the second press member against the first conveyance member, when the recording medium detector detects that the recording medium is conveyed to a predetermined position.

17. The image formation apparatus of claim 14, wherein the fixation device further includes a temperature measurement unit configured to measure a temperature of the first conveyance member, and the controller controls the support mechanism to switch to a mode of pressing the second press member against the first conveyance member, when the temperature of the first conveyance member measured by the temperature measurement unit reaches a first temperature range.

18. The image formation apparatus of claim 14, wherein the fixation device further includes a temperature measurement unit configured to measure a temperature of the first conveyance member, and the controller controls the support mechanism to switch to a mode of pressing the second press member against the first conveyance member, when the temperature of the first conveyance member measured by the temperature measurement unit is in a second temperature range.

19. The image formation apparatus of claim 14, wherein the controller controls the support mechanism to switch to a mode of pressing the second press member against the first conveyance member, when detecting the first printing after the image formation apparatus is powered on.

20. The image formation apparatus of claim 1, further comprising:

a recording medium conveyance unit configured to convey a recording medium; and a recording medium detector configured to detect the recording medium at a position upstream of the fixation device in the recording medium, wherein the controller is configured, when the recording medium detector detects the recording medium, to control the support mechanism to press the first and second press members against the first conveyance member.

21. The image formation apparatus of claim 1, further comprising:

a heater configured to heat the fixation device, wherein the controller is configured to, after the heater is turned on, to control the support mechanism to switch from a mode of separating the first and second press members from the first conveyance member to a mode of pressing the first press member against the first conveyance member and separating the second press member from the first conveyance member.

* * * * *